US009989226B2

(12) United States Patent
Raya et al.

(10) Patent No.: US 9,989,226 B2
(45) Date of Patent: Jun. 5, 2018

(54) UP—DOWN TREE LIGHTING

(71) Applicants: Ralph A. Raya, Palm Desert, CA (US); Ralph C. Raya, Palm Desert, CA (US)

(72) Inventors: Ralph A. Raya, Palm Desert, CA (US); Ralph C. Raya, Palm Desert, CA (US)

( * ) Notice: Subject to any disclaimer, the term of this patent is extended or adjusted under 35 U.S.C. 154(b) by 0 days. days.

(21) Appl. No.: 15/064,905

(22) Filed: Mar. 9, 2016

(65) Prior Publication Data

US 2016/0265751 A1 Sep. 15, 2016

Related U.S. Application Data

(60) Provisional application No. 62/130,500, filed on Mar. 9, 2015.

(51) Int. Cl.

| | |
|---|---|
| ***F21V 21/08*** | (2006.01) |
| ***F21S 8/08*** | (2006.01) |
| *F21W 131/10* | (2006.01) |
| *F21Y 115/10* | (2016.01) |
| *F21Y 113/10* | (2016.01) |

(52) U.S. Cl.

CPC ..... *F21V 21/08* (2013.01); *F21S 8/085* (2013.01); *F21W 2131/10* (2013.01); *F21Y 2113/10* (2016.08); *F21Y 2115/10* (2016.08)

(58) Field of Classification Search

None

See application file for complete search history.

(56) References Cited

U.S. PATENT DOCUMENTS

| | | | | |
|---|---|---|---|---|
| 2,047,045 | A | 1/1935 | Veenboer | |
| 2,453,695 | A | 3/1946 | Belling | |
| 2,478,278 | A | 8/1949 | Kiesow | |
| 3,752,407 | A | 8/1973 | Baugh et al. | |
| 4,462,065 | A * | 7/1984 | Rhodes | F21V 21/02 362/123 |
| 5,984,489 | A * | 11/1999 | Rubenstein | F21S 2/00 362/123 |
| 6,224,231 | B1 * | 5/2001 | Personius | F21V 19/04 362/123 |
| 6,869,198 | B1 | 3/2005 | Garza | |
| 7,014,331 | B2 * | 3/2006 | Risch | F21V 21/08 362/123 |
| 7,334,921 | B1 | 2/2008 | Simnor | |
| 7,575,212 | B1 * | 8/2009 | Langelius | A47B 57/42 211/192 |
| 8,684,551 | B2 | 4/2014 | Alsaffar | |

(Continued)

*Primary Examiner* — Kristy A Haupt

(74) *Attorney, Agent, or Firm* — Kirk A. Buhler; Buhler Associates

(57) ABSTRACT

Improvements in an up-down lighting fixture that is mountable to a trunk or branch at whatever elevation that is desired to provide the required illumination to light the fronds, head or a tree as well and some lighting can be directed downward to illuminate the ground or a pathway under the tree or a wall. The lighting is secured to a tree with a first bracket that is secured to the tree and a second lighting frame that is then secured to the tree brackets. The frame is constructed from aluminum or other metals and further coated or painted to blend with the color of the trunk of the tree. The system includes optional field adjustable switched to allow for multiple levels of illumination. The lighting optics can include multiple LED color temperatures to adjust the lighting for the surroundings or to provide a desired ambiance.

21 Claims, 6 Drawing Sheets

(56) References Cited

U.S. PATENT DOCUMENTS

| | | | | |
|---|---|---|---|---|
| 2009/0084601 | A1* | 4/2009 | Masinter | H01R 13/52<br>174/520 |
| 2014/0042291 | A1* | 2/2014 | Colarusso | F21V 21/00<br>248/544 |

* cited by examiner

UP—DOWN TREE LIGHTING

CROSS REFERENCE TO RELATED APPLICATIONS

This application claims the benefit of Provisional Application Ser. No. 62/130,500 filed Mar. 9, 2015 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in lighting for a tree, palm tree or other structure. More particularly, the present up-down lighting fixture provides lighting elements that are secured to the trunk of a tree to provide illumination up and/or down from the tree frame attached to a mounting bracket that is mounted to the trunk of a tree. The lighting elements may also be mounted to the outside of the frame to direct light away from the trunk.

Description of Related Art Including Information Disclosed Under 37 CFR 1.97 and 1.98

There are a number of establishments including, but not limited to commercial property, hotels, resorts and homes that want to provide lighting features to illuminate a tree or an area around a tree. Placing a light on the ground that shines into a tree provides lighting for the branches, leaves and fronds. Placing lighting on the ground requires selecting lights that must focus or spread light depending upon the distance from the lighting to the branches, leaves or fronds. Placing lighting on the ground does not provides even illumination of the ground area around the base of the tree. Placing lighting on the ground can be damaged, removed or broken by pedestrians, maintenance gardeners etc.

Some lighting systems secure lighting in the tree that shines lights from a fixture strap. These fixtures are fixed to a strap around the living tree and the lights are placed around the outside of the fabric or metal strap and are larger than the strap. A number of patents and or publications have been made to address these issues. Exemplary examples of patents and or publication that try to address this/these problem(s) are identified and discussed below.

U.S. Pat. No. 7,014,331 issued Mar. 21, 2006 to Charles E. Risch discloses a Light System on Trees and Other Objects. The system involves a flexible multiple bulb light rod or a continuous string of lights. The lights provide only localized illumination and does not shine light in a particular focused direction such as into palm fronds or onto the ground.

U.S. Pat. No. 8,684,551 issued on Apr. 1, 2014 to Abdukreidha A. AlSaffar disclose a Lighting Assembly in the Form of a Palm Tree. The base includes a plurality of downwardly extending rods and a mass of concrete around and in between the rods to anchor the assembly. The lighting system is essentially a fake tree with integrated lighting. While this patent discloses illumination, there is not a ring of lighting that is securable to a living tree.

What is needed is a lighting fixture system that is secured to a tree or palm tree where the lights are secured within a lighting round or square metal frame. The lighting fixture system disclosed in this document provides a solution to providing illumination to a tree and/or palm tree or other structure and further provides lighting around a tree with the lighting elements positioned and hidden between the metal frame and the base.

BRIEF SUMMARY OF THE INVENTION

It is an object of the up-down lighting fixture to provide illumination for/from a palm tree or other structure. The lighting fixture is mountable to a trunk at whatever elevation that is desired to provide the required illumination. The height of installation provides a greater or lesser distance for the lighting to spread to light the fronds spread of a head of a tree or other structure as well and some lighting can be directed downward to illuminate the ground or a pathway under the tree. In all cases the lights are hidden behind the frame.

It is an object of the up-down lighting fixture to have interchangeable lighting fixtures. The lighting fixtures can be incandescent, light emitting diodes (LED's) or solid state components. The lighting elements can be individually or collectively replaced. The system illuminating fixture further includes optional field adjustable switches to allow for multiple levels of illumination. The lighting fixtures can further includes (RGB or RGBW) multiple LED color diodes to adjust the lighting to various colors of light for the surroundings or to provide a desired ambiance. The up lighting can further be different from the down lighting both in color and intensity. Red, Green, Blue (RGB) lighting fixtures allow for tuning the color of light that is emitted from the fixture. All lighting fixtures are provided with optics to adjust lighting beam spreads to achieve a desired lighting effect. All of the lighting optics are interchangeable It is another object of the up-down lighting fixture to be secured to the tree with interconnecting brackets. One set of brackets (4) is secured into the tree. The lighting frame is then secured to the tree brackets and at no time does the metal frame or lights come into contact with the tree. The bracketing allows for leveling the components frame and lights on a tree as the lighting is being secured to the tree to insure that the frame is level.

It is another object of the up-down lighting fixture round or square frame to appear as an architectural feature with all lights hidden as opposed to one or more lights that are secured directly to a tree trunk. The lighting exists between the four (4) tree brackets and the supporting frame without making contact with the tree. The lights are adjustable on the frame where they are essentially invisible from certain ground perspectives. The frame is constructed from aluminum, stainless steel or other metals and further is coated or painted to blend with the color of the trunk of the tree. Because the lights are placed within the outer frame, the frame provides some additional protection. The lighting elements are pivotally secured to the frame and each lighting element is adjustable for the direction of illumination. While the lighting elements are preferably placed within the frame, lights can also be placed outside of the frame to illuminate other areas or advertising placed on wall or building. The square and round metal frames can be sized and conserved for various diameter of trunks, limbs or poles.

It is still another object of the up-down lighting fixture to be created using LED lighting fixtures that are furnished with various kelvin color temperature or an RGB or RGBW source to create a color changing effect on the palm tree or other structure if desired.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
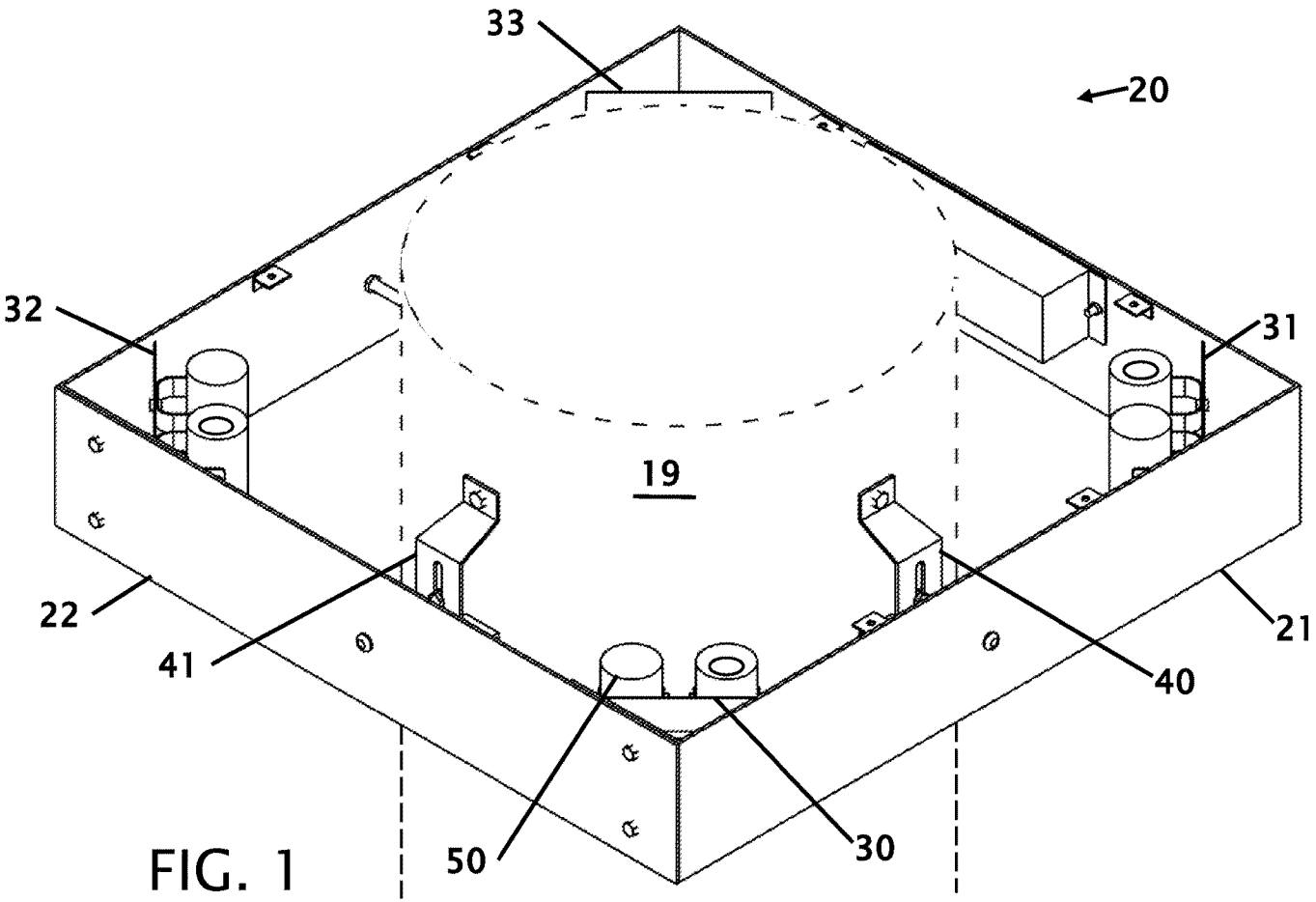
FIG. 1 shows a perspective view of a square up-down lighting fixture installed on a tree, palm tree or other structure.
Figure 2:
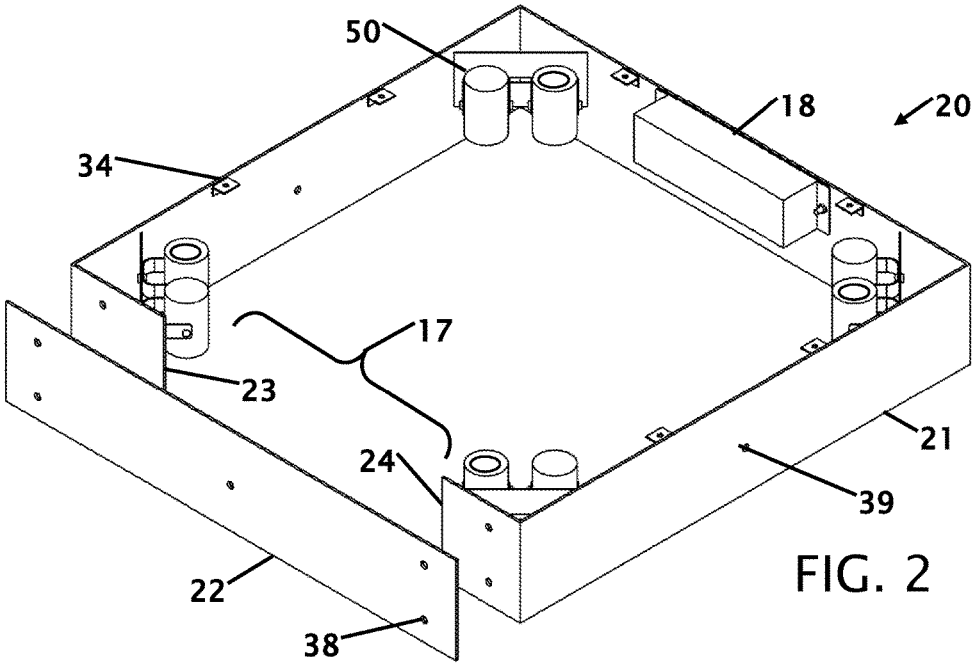
FIG. 2 shows a first perspective view of the square up-down lighting fixture frame from FIG. 1.
Figure 3:
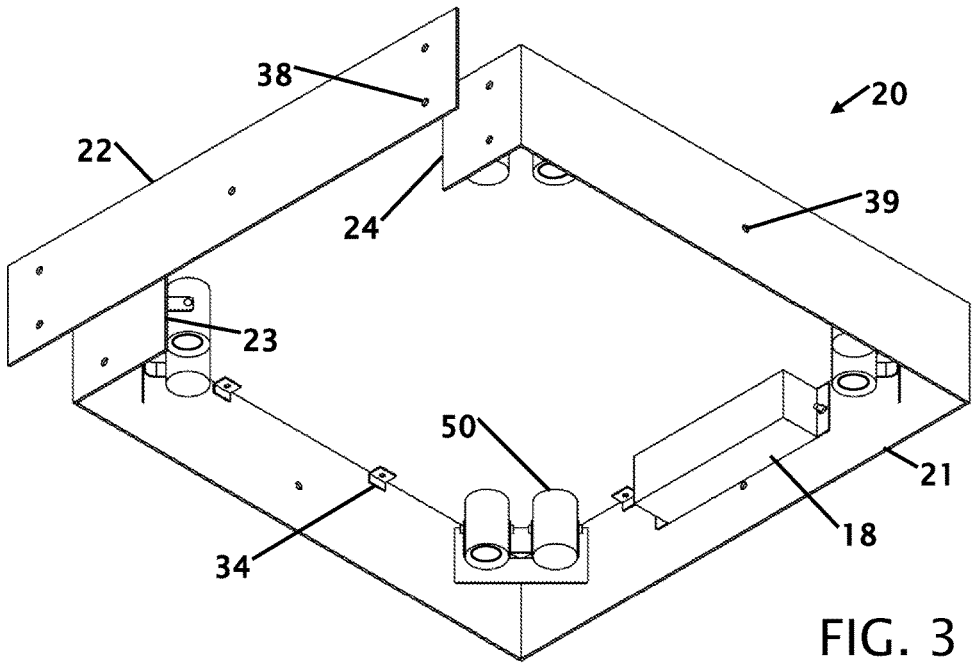
FIG. 3 shows a second perspective view of the square up-down lighting fixture frame from FIG. 1.

FIG. 1 shows a perspective view of a square up-down lighting fixture 20 installed on a tree, palm tree or other structure 19, FIG. 2 shows a first perspective view of the square up-down lighting fixture frame 21 from FIG. 1 and FIG. 3 shows a second perspective view of the square up-down lighting fixture frame 21 from FIG. 1. The lighting system is preferably configured to fit around a tree, palm tree, trunk or other structure 19, but can also be installed on the trunk or limb of a tree or on a pole, such as a telephone pole or street light or building column or vertical structure. A plurality of brackets leveling brackets 40, 41 are first secured onto the tree 19 or pole. In this embodiment four leveling brackets 40, 41 are installed onto the tree 19 or pole, but a few as three provide a planar orientation. It is contemplated that as few as two brackets 40 can be used, but using less than three leveling brackets 40 reduces stability and longevity. The leveling brackets 40, 41 are screwed into the tree, palm tree or other structure using stainless steel screws into the tree 19 or pole. The leveling brackets (like) 40 and 41 are made from aluminum, stainless steel or other metals. All the bolts, hangers, nuts and washers can be stainless steel or other metals.

Hardware, such as screws, bolts or threaded shafts connect the leveling bracket(s) 40 to the support structure 21 at location(s) 39. The support structure 21 in this embodiments to essentially a rectangular or square frame 21 that is open on one side with a removable section 22. While the section 22 is shown as being removable, the section could also be hinged to the frame 21. Section 22 is shown secured onto bent tabs 23 and 24 that can be bent, welded, or the like, onto the support structure 21. In this embodiment, fasteners are placed into holes 38 to secure the removable section 22 onto the frame 21. With the frame configured as shown, the trunk or pole 19 can pass though the opening 17 in the frame 21.

While the frame many be shown and described as rectangular or square, other shapes are contemplated including, but not limited to triangular, pentagonal, hexagonal, octagonal and round as also shown and described in this document. A junction box, transformer or other enclosure 18 provides a common location where power enters the up-down lighting fixture 20 and the power is then distributed to the lighting elements 51. In each of the corners one or more lighting elements 50 are placed and are secured with brackets 30, 31, 32 and 33. Tabs 34 allow the support of additional lighting, conduit or wiring secured to the support structure 21.

Figure 4:
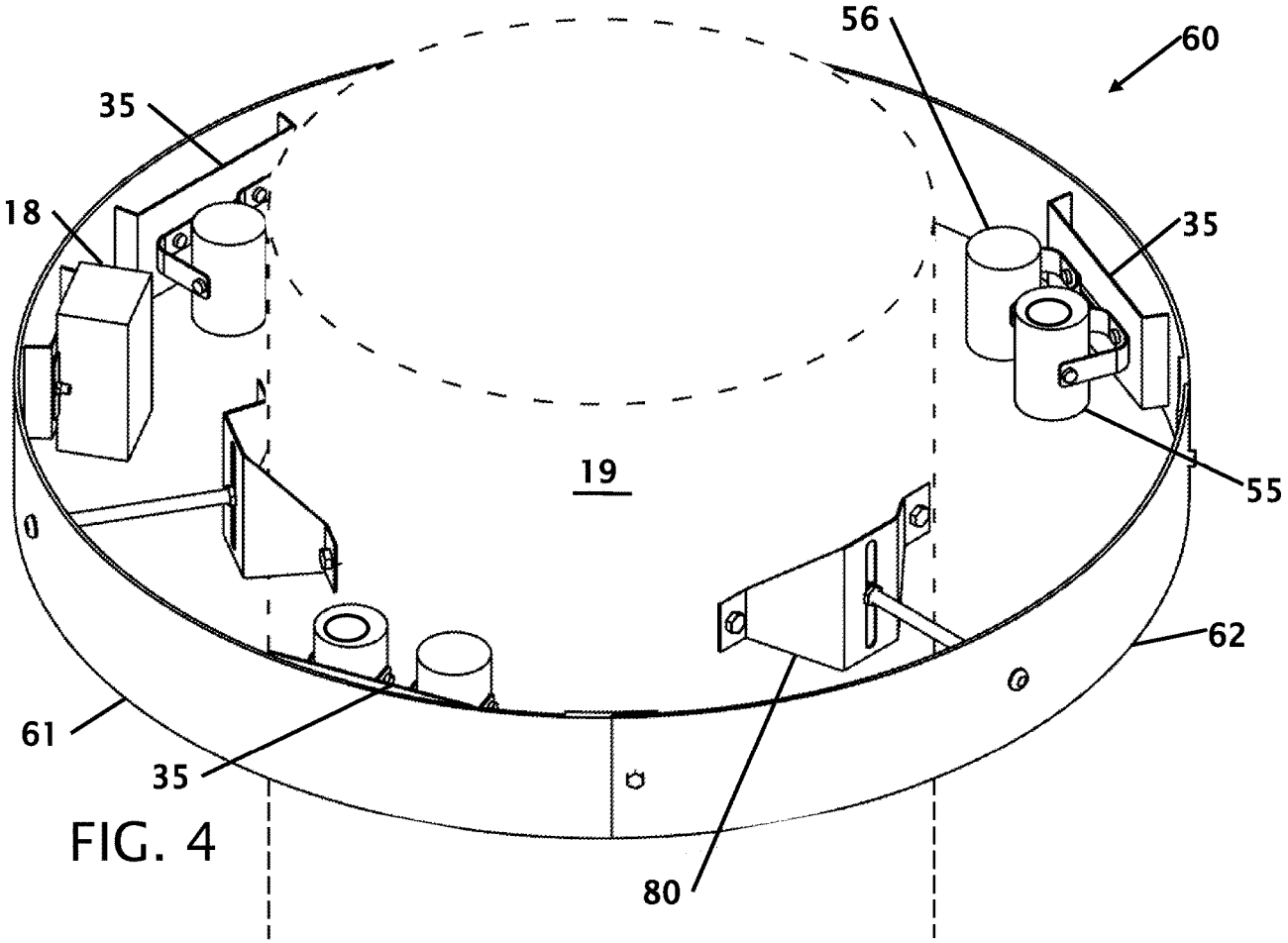
FIG. 4 shows a perspective view of a round up-down lighting fixture installed on a tree.
Figure 5:
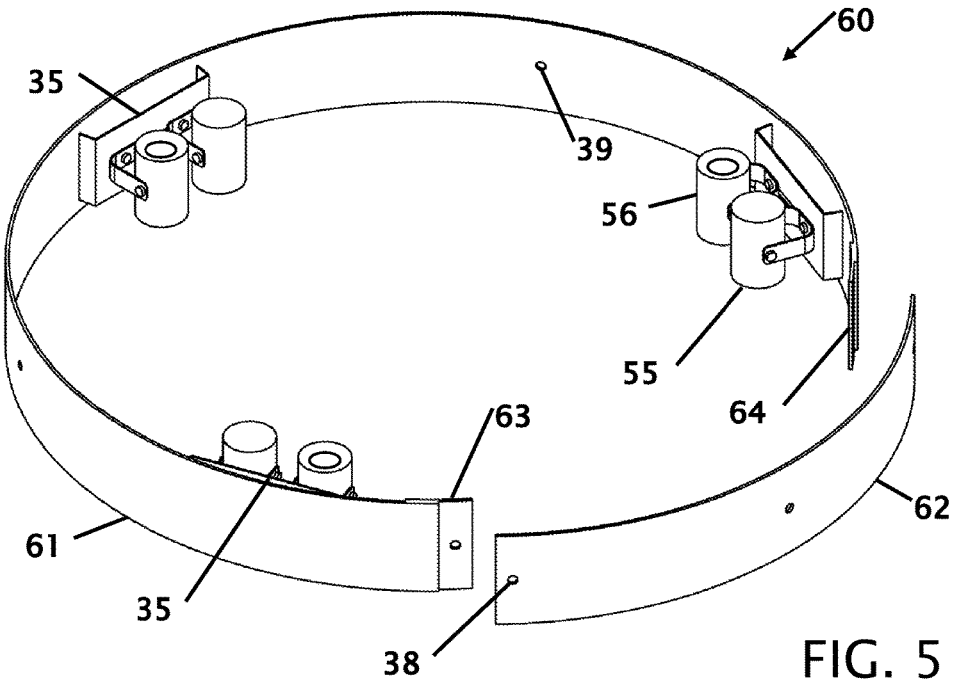
FIG. 5 shows a first perspective view of the round up-down lighting fixture frame from FIG. 4.
Figure 6:
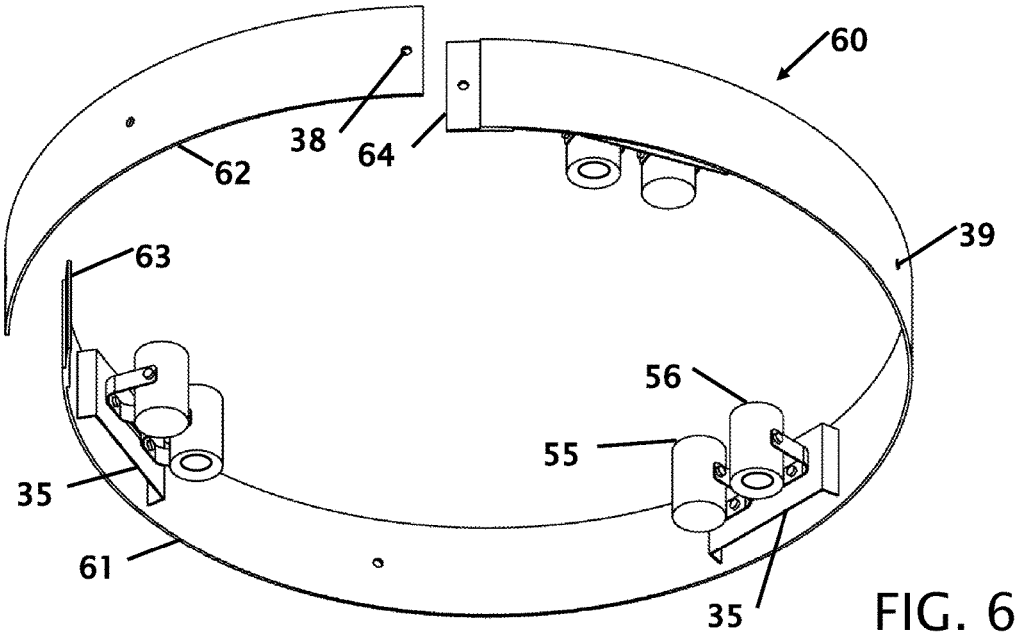
FIG. 6 shows a second perspective view of the round up-down lighting fixture frame from FIG. 4.

FIG. 4 shows a perspective view of a round up-down lighting fixture 60 installed on a tree 19, FIG. 5 shows a first perspective view of the round up-down lighting fixture frame 61 from FIG. 4 and FIG. 6 shows a second perspective view of the round up-down lighting fixture frame 61 from FIG. 4. This embodiment shows three brackets 80 that secure the frame to the tree 19, pole or other structure. Holes 39 in the frame 61 provide connection points for mounting the brackets 80. Additional description of the brackets 80 is shown and described in more detail in FIG. 10 herein. This embodiment also shows three sets of lights 55 (four sets or more) of lights on brackets 35 secured to the frame. While only two sets of lights 55 and 56 are shown on the bracket 35, four or more sets of lights 55 could also be installed with each bracket 35. Three sets of lights 55 will generally provide complete illumination with some overlap, but as few as two sets are contemplated. In this embodiment the frame 61 is configured in a curved section with a removable sector 62 that are fastened 38 together. Overlapping tabs 63 and 64 provide the appearance of a continuous circle and provide structural support for the removable sector 62.

The circle (or rectangular) embodiments provide an architecturally pleasing appearance to the lighting frame. The construction of the frame, electronics and lights utilize IP63, IP65, IP67, UL or ETL recognized components. The materials used in the frame and brackets are preferably made from aluminum, stainless steel or other metals such as stainless steel that is powder coated or painted to match the color of the tree, palm tree, pole or other structure. While particular material and finishes are described, one skilled in the art can recognize multiple variations that would provide equivalent performance.

The electrical junction box 18 can be provided with surge protection to protect both the lighting elements 55, 56 from surges that come from a power supply and can also provide protections to the wiring caused by a lightning strike or other localized anomaly that may cause a disturbance to the electrical wiring.

Figure 7:
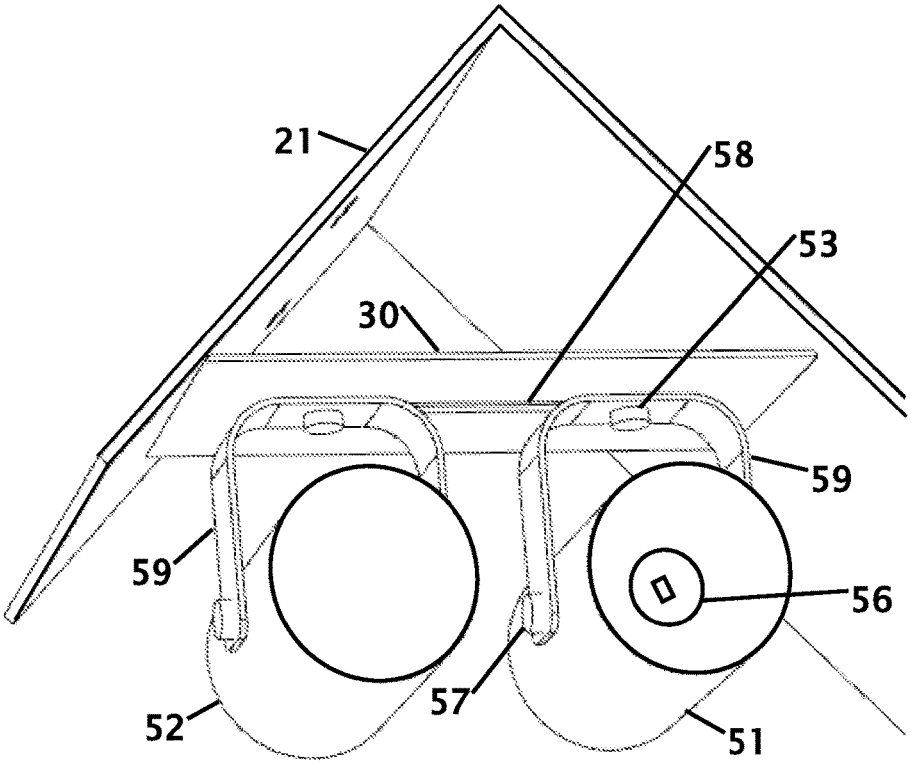
FIG. 7 shows a perspective detail of the lights in the square frame configuration.
Figure 8:
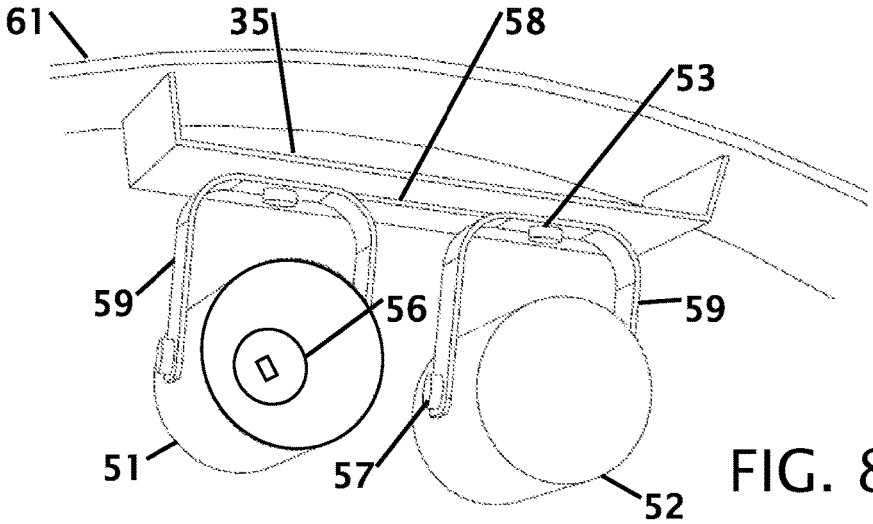
FIG. 8 shows a perspective detail of the lights in the round frame configuration.

FIG. 7 shows a perspective detail of the lights in the square frame 21 configuration and FIG. 8 shows a perspective detail of the lights in the round frame 61 configuration. The wiring from the junction box (not shown) or other power source is connected to the lighting elements 51 and 52. These figures show lights shining in opposite directions where the illumination element 56 is visible on only one of the cans 51 or 52. The fixtures provide multiple different configurations where lights 51 and 52 are configured within the frames 21, 60 but can also be installed outside of the frame structure 21, 61.

In the preferred embodiment the lighting elements are light emitting diodes (LED's) and/or solid state components, but could be other illumination elements based upon the voltage and illumination specification requirements. It is contemplated that the lights are available with multiple levels of intensities of illumination where the levels of illumination are configured with field adjustable internal switches or remote control. It is further contemplated that the lighting can be supplied with RGB multiple LED color temperatures and for the lighting to use interchangeable optics. To control light beam spreads.

The lighting fixtures 51 and 52 are secured with brackets 59 through pivoting hardware 57. The brackets 59 are then connected with hardware 53 through a hole or elongated slot 58 on the bracket 30. This configuration allows the lighting from the can lights 51 and 52 to be directed at an angle from the supporting frame structure 21 and 61.

Figure 9:
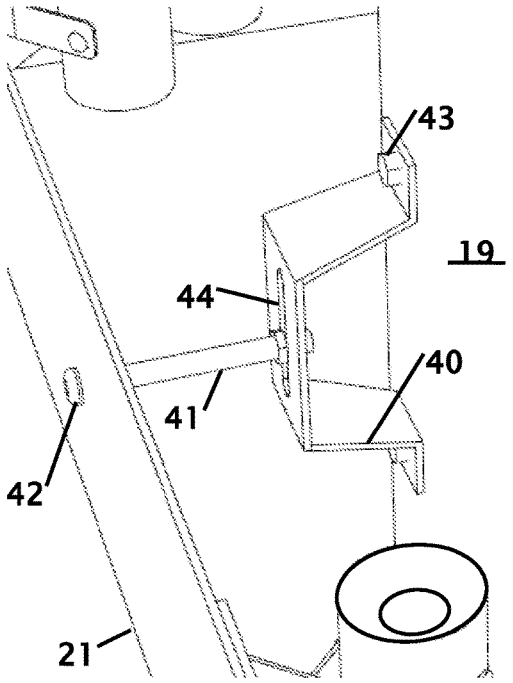
FIG. 9 shows a perspective view of the mounting bracket in the square frame configuration.
Figure 10:
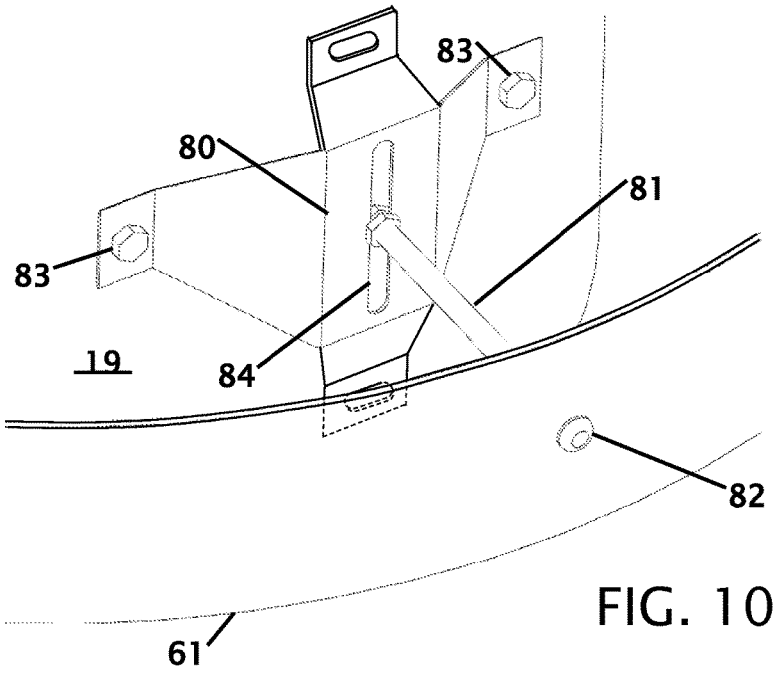
FIG. 10 shows a perspective view of the mounting bracket in the round frame configuration.

FIG. 9 shows a perspective view of the tree, palm tree or other structure 19 mounting leveling bracket 40 in the square frame 21 configuration and FIG. 10 shows a perspective view of the tree, palm tree or other structure 19 mounting bracket 80 in the round frame 61 configuration. The leveling brackets 40 and 80 have a vertical slot 44 and 84 that allows the frame 21, 61 to be leveled. Hardware of stainless steel screws 43, 83 bolts secures the leveling bracket(s) 40 and 80 into the tree 19 or pole.

Each leveling bracket 40 and 80 has bent ears to allow the central area of the leveling bracket 40 and 80 to be elevated from the tree 19 or pole. A screw, bolt or shaft 41, 81 connects the leveling bracket 40, 80 to the frame 21, 61. The head 42, 82 of the screw, bolt or shaft 41, 81 extends outside of the frame 21 and 61 so the adjustable threaded end of the screw, bolt or shaft 41, 81 is essentially hidden behind the leveling bracket 40, 80.

Thus, specific embodiments of an up-down lighting fixture have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An up-down lighting fixture comprising:

at least three separate brackets for securing to a tree or pole;

a metal support structure that is secured to said at least three separate brackets with shafts within a top plane and a bottom plane of said metal support structure that space said metal support structure around said at least three separate brackets;

said metal support structure having a removable or hinged structure for passing said metal support structure ring around said tree or pole;

said metal support structure further including securing means for securing at least one illuminating element completely within said top plane and said bottom plane of said metal support structure between said at least three separate brackets and said metal support structure.

2. The up-down lighting fixture according to claim 1, wherein said metal support structure is round.

3. The up-down lighting fixture according to claim 1, wherein there are four separate brackets and said metal support structure is rectangular.

4. The up-down lighting fixture according to claim 1, wherein all lighting elements, wiring, junction boxes are shielded by said metal support structure.

5. The up-down lighting fixture according to claim 1 wherein said metal support structure is coated or painted.

6. The up-down lighting fixture according to claim 1 wherein said at least one illuminating element is not visible from at least one viewing position.

7. The up-down lighting fixture according to claim 1 wherein said metal support structure and said at least one illuminating element in not in direct contact with said tree or said pole.

8. The up-down lighting fixture according to claim 1 wherein said at least one illuminating element is a single-color temperature or a red-green-blue colored illumination element with replaceable optics with an adjustable light beam.

9. The up-down lighting fixture according to claim 1 wherein said at least one illuminating element and electrical components are U.L. listed.

10. The up-down lighting fixture according to claim 1 wherein said up-down lighting is powered from a voltage source of between 12 and 208 volts.

11. The up-down lighting fixture according to claim 1, wherein said at least three separate brackets are each independently adjustable with respective metal shafts in a planar relationship relative to said metal support structure.

12. The up-down lighting fixture according to claim 11 wherein said at least three separate brackets are secured to said metal support structure with threaded couplers.

13. The up-down lighting fixture according to claim 1, wherein said at least one illuminating element is adjustably secured to said metal support structure.

14. The up-down lighting fixture according to claim 1 further includes an electrical junction box.

15. The up-down lighting fixture according to claim 14 wherein said electrical junction box encloses a transformer or a power converter or a power inverter.

16. The up-down lighting fixture according to claim 1 wherein each of said at least three separate brackets have a slotted hole wherein said shafts are secured.

17. The up-down lighting fixture according to claim 16 wherein said shafts are threaded.

18. The up-down lighting fixture according to claim 1 wherein said at least three separate brackets are secured to said tree or pole with at least two fasteners per separate bracket.

19. The up-down lighting fixture according to claim 1 wherein said shafts are adjustable to center said metal support structure around said at least three separate brackets.

20. The up-down lighting fixture according to claim 1 wherein none of said at least three separate brackets obstruct said light from said at least one illuminating element.

21. The up-down lighting fixture according to claim 1 wherein none of said shafts obstruct said light from said at least one illuminating element.

* * * * *